United States Patent [19]

Sodeno

[11] Patent Number: 4,736,880

[45] Date of Patent: Apr. 12, 1988

[54] PUNCH ASSEMBLY FOR GARMENT FASTENER ATTACHING APPARATUS

[75] Inventor: Toshiaki Sodeno, Toyama, Japan

[73] Assignee: Yoshida Kogyo K. K., Tokyo, Japan

[21] Appl. No.: 927,099

[22] Filed: Nov. 5, 1986

[30] Foreign Application Priority Data

Nov. 12, 1985 [JP] Japan ..... 60-173976

[51] Int. Cl.[3] ..... B25C 7/00

[52] U.S. Cl. ..... 227/149; 227/30

[58] Field of Search ..... 227/30, 31, 32, 35, 227/124, 149, 153, 155, 15

[56] References Cited

U.S. PATENT DOCUMENTS 4,579,270 4/1986 Matsuda ..... 227/149

FOREIGN PATENT DOCUMENTS 2059746 4/1981 United Kingdom .

2152867 8/1985 United Kingdom .

*Primary Examiner*—E. R. Kazenske

*Assistant Examiner*—James L. Wolfe

*Attorney, Agent, or Firm*—Hill, Van Santen, Steadman & Simpson

[57] ABSTRACT

In an apparatus for joining together a pair of fastener elements of a garment fastener, such as a snap fastener, a button or an ornamental article, with a garment fabric sandwiched between the two fastener elements, a punch assembly for forcing one fastener element against its mating fastener element has a clamp-holder divided into a pair of separate pieces, and an adjustable spring means for imparting an appropriate amount of braking force to the two clamp-holder pieces.

2 Claims, 3 Drawing Sheets

PUNCH ASSEMBLY FOR GARMENT FASTENER ATTACHING APPARATUS

BACKGROUND OF THE INVENTION

1. Field of the Invention

The present invention relates to an apparatus for joining together a pair of fastener elements of a garment fastener, such as a snap fastener, a button or an ornamental article, with a garment fabric sandwiched between the two fastener elements. More particularly, the invention relates to a punch assembly for forcing one fastener element against its mating fastener element placed on a die.

2. Description of the Prior Art

Punch assemblies for the purpose decribed above are known which generally comprise a tubular clamp-holder, a pair of clamps pivotally mounted on a lower end of the clamp holder for gripping a disk-like head of a button body, a punch-holder vertically slidable in the clamp-holder, and a punch mounted on a lower end of the punch-holder for forcing the button body out of the clamps against its mating fastener element placed on a die. The clamp-holder is normally urged downwardly by means of a compression spring. A common problem with the known button assemblies is in that due to the compression spring, the clamps would be brought in contact with the garment fabric with a relatively great force when the clamp-holder is lowered toward the die, thus breaking or otherwise impairing the garment fabric.

SUMMARY OF THE INVENTION

It is therefore an object of the present invention to provide a punch assembly in which a clamp-holder is reduced in weight and is adapted to receive an appropriate amount of braking force, thereby preventing a garment fabric from being broken or otherwise impaired.

According to the present invention, a punch assembly has a clamp-holder divided into two separate pieces and an adjustable spring means for imparting an appropriate amount of braking force to the two clamp-holder pieces.

Many other advantages, features and additional objects of the present invention will become manifest to those versed in the art upon making reference to the detailed description and the accompanying sheets of drawings in which one preferred structural embodiment incorporating the principles of the present invention is shown by way of illustrative example.

DETAILED DESCRIPTION

Figure 1:
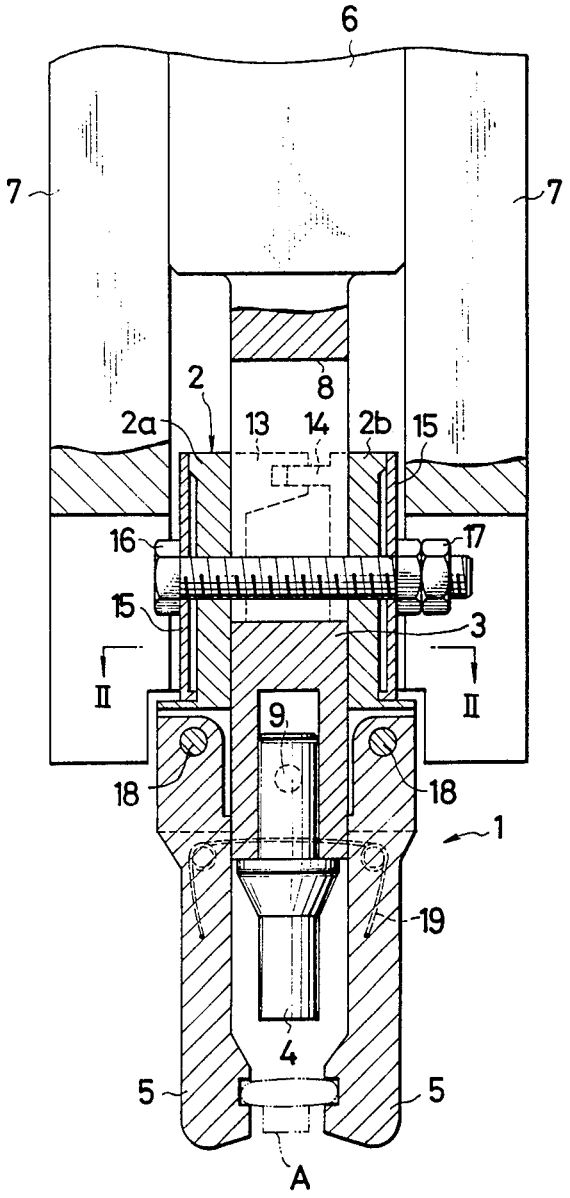
FIG. 1 is a front elevational view, with parts broken away of a punch assembly embodying the present invention.

FIG. 1 shows a punch assembly 1 for a button attaching apparatus for joining together a pair of fastener elements, such as a button, with a garment fabric (not shown) sandwiched between the two fastener elements.

The punch assembly 1 generally comprises a clamp-holder 2 vertically slidable on a frame 7 in a manner described below, a pair of clamps 5,5 pivotally mounted on a lower end of the clamp-holder 2 for gripping one fastener element such as a button body A, and a punch-holder 3 vertically slidably received in the clamp-holder 2 and connected at its upper end to a reciprocable ram 6 and at its lower end to a punch 4.

Figure 2:
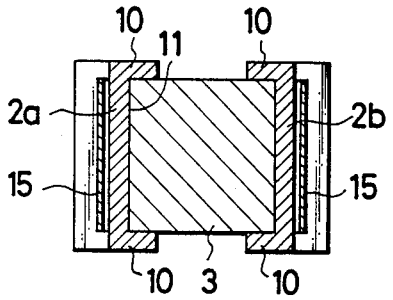
FIG. 2 is a cross-sectional view taken along line II—II of FIG. 1.
Figure 4:
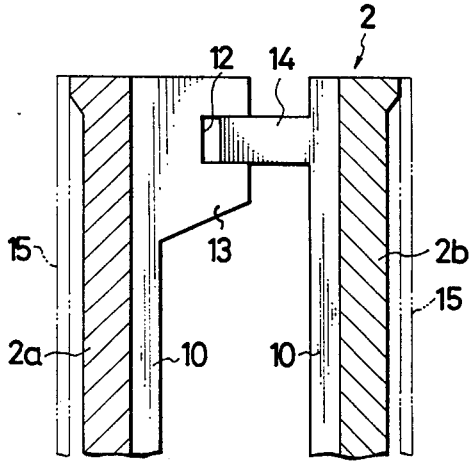
FIG. 4 is a fragmentary enlarged cross-sectional view taken along line IV—IV of FIG. 3.
Figure 3:
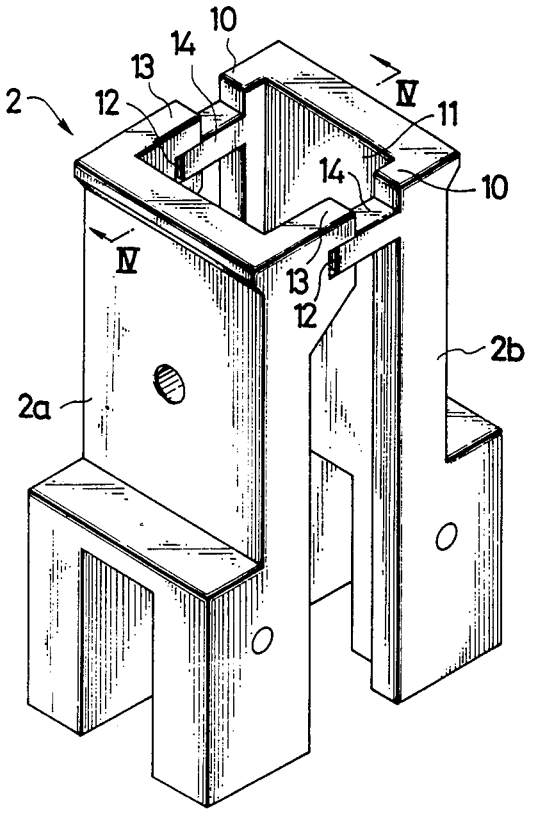
FIG. 3 is a perspective view of a clamp-holder.

As shown in FIG. 2, the punch-holder 3 has a rectangular cross-section and has in its upper portion a vertically elongated opening 8 (FIG. 1), for a purpose described below. The punch 4 is fixedly secured to the lower end of the punch-holder 3 by means of a screw 9 (FIG. 1).

Most importantly, as shown in FIGS. 1–4, the clamp-holder 2 is divided into a pair of separate pieces *2a, 2b* each having a pair of side flanges 10,10 directed toward each other piece *2b, 2a*. The two clamp-holder pieces *2a, 2b* define therebetween a longitudinal space 11 in which the punch-holder 3 is vertically slidably received; the two pairs of side flanges 10,10 and 10,10 serve to prevent the punch-holder 3 from being displaced in lateral or transverse directions. One of the clamp-holder pieces *2a* has at its upper portion a pair of first projections 13,13 extending from the pair of side flanges 10,10, respectively, and having a pair of recesses 12,12 in which a pair of second projections 14,14 extending from the pair of side flanges 10,10 of the other clamp-holder piece *2b* are received, so that the two clamp-holder pieces *2a, 2b* are prevented from relative vertical displacement.

Further, the two clamp-holder pieces *2a, 2b* are normally urged toward each other, i.e. against the punch-holder 3 by a pair of leaf springs 15,15 which are fastened to the respective clamp-holder pieces *2a, 2b* by means of a threaded bolt 16 (FIG. 1) and a nut 17 (FIG. 1). As shown in FIG. 1, the bolt 16 extends through the two leaf springs 15,15 and the two clamp-holder pieces *2a, 2b* and also through the opening 8 of the punch-holder 3, and the nut 17 is adjustably and threadedly mounted on the bolt 16. By adjusting the position of the nut 17 on the bolt 16, it is possible to vary the amount of biasing force of the leaf springs 15,15 under which the two clamp-holder pieces *2a, 2b* are urged against the punch-holder 3. Thus, it is possible to impart to the two clamp-holder pieces *2a, 2b* an appropriate amount of braking force which increases friction between the clamp-holder 2 and the punch-holder 3 so that the garment fabric is prevented from being broken or otherwise impaired when the clamps 5,5 are brought in contact with the garment fabric as the punch-holder 2 is lowered by the ram 6.

As mentioned above, the clamp-holder 2 is frictionally supported on the punch-holder 3 for sliding movement relative thereto. The vertical movement of the two holders 2, 3 relative to each other is restricted within the length of the opening 8 of the punch-holder 3 in which opening the bolt 16 is vertically slidably received.

As shown in FIG. 1, each of the pair of clamps 5 is pivotally connected at its upper end to the lower end of the respective clamp-holder piece *2a, 2b* by means of a pin 18. A spring 19 acts on the pair of clamps 5,5 so as to normally urge their lower ends toward each other for gripping one fastener element such as a button body A therebetween.

In operation, as the ram 6 is moved downwardly in FIG. 1, the punch-holder 3 is lowered together with the clamp-holder 2. At that time one fastener element such as a button body A is gripped between the pair of clamps 5,5. When the clamps 5,5 are brought into contact with a garment fabric (not shown) disposed over a mating fastener element such as a tack (not shown) placed on a die (not shown), the lowering of the clamp-holder 2 with the clamps 5,5 is halted against the braking force that is derived from the biasing force of the leaf springs 15,15 which biasing force is adjusted to an appropriate value. In the meantime, with continued downward movement of the ram 6, the punch-holder 3 slides downwardly in the space 11 defined between the pair of clamp-holder pieces 2*a*, 2*b*, causing the punch 4 to force the button body A out of the pair of clamps 5,5 against the tack (not shown), at which time the lower ends of the pair of clamps 5,5 are moved away from each other against the bias of the spring 19. As a result, the button body A has been joined with the non-illustrated tack, with the non-illustrated garment fabric sandwiched between such two fastener elements.

With the punch assembly 1, it is possible to join together a pair of fastener elements of a garment fastener, such as a snap fastener, a button or an ornamental article, without breaking or otherwise impairing a garment fabric to which the garment fastener is being attached, partly because the two-piece clamp-holder 2 is rather light in weight compared to the prior art clamp-holder which is only a single piece, and partly because an appropriate amount of braking force is imparted to the pair of clamp-holder pieces 2*a*, 2*b* by means of the leaf springs 15,15 which are adjustably fastened to the respective clamp-holder pieces 2*a*, 2*b* by the threaded bolt 16 and the nut 17.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A punch assembly for forcing a garment fastener element against its mating fastener element placed on a die with a garment fabric sandwiched between such two fastener elements, said punch assembly comprising;

(a) a frame;

(b) a clamp-holder vertically slidable on said frame and divided into a pair of vertically extending separate pieces so as to define therebetween a longitudinal space;

(c) a pair of clamps pivotally mounted on a lower end of said clamp-holder for gripping the first-named fastener element therebetween;

(d) a vertically extending punch-holder slidably received in said longitudinal opening of said clamp-holder and operatively connected to a reciprocable ram for vertical movements;

(e) a punch mounted on a lower end of said punch-holder for pushing the gripped fastener element out of said pair of clamps toward the die and hence against the mating fastener element thereon in response to downward movement of said punch-holder; and (f) adjustable spring means for imparting an appropriate amount of braking force to said clamp-holder pieces, said adjustable spring means including a pair of leaf springs normally urging the respective clamp-holder pieces, against said punch-holder, and a bolt and nut assembly adjustably fastening said leaf springs to said clamp-holder pieces.

2. A punch assembly, for forcing a garment fastener element against its mating fastener element placed on a die with a garment fabric sandwiched between such two fastener elements, said punch assembly comprising;

(a) a frame;

(b) a clamp-holder vertically slidable on said frame and divided into a pair of vertically extending separate pieces so as to define therebetween a longitudinal space; each of said pair of clamp-holder pieces having a pair of side flanges directed toward each other piece, one of said clamp-holder pieces having a pair of first projections extending from the respective side flanges, said pair of first projections having in their respective ends a pair of recesses, the other clamp-holder piece having a pair of second projections extending from the respective side flanges and received in said pair of recesses respectively;

(c) a pair of clamps pivotally mounted on a lower end of said clamp-holder for gripping the first-named fastener element therebetween;

(d) a vertically extending punch-holder slidably received in said longitudinal opening of said clamp-holder and operatively connected to a reciprocable ram for vertical movements;

(e) a punch mounted on a lower end of said punch-holder for pushing the gripped fastener element out of said pair of clamps toward the die and hence against the mating fastener element thereon in response to downward movement of said punch-holder; and (f) adjustable spring means for imparting an appropriate amount of braking force to said clamp-holder pieces.

* * * * *